US011365019B2

(12) United States Patent
Lai

(10) Patent No.: US 11,365,019 B2
(45) Date of Patent: Jun. 21, 2022

(54) STRAPPING MACHINE

(71) Applicant: EXPACK INDUSTRIAL CORPORATION, Taichung (TW)

(72) Inventor: Yu-Ting Lai, Taichung (TW)

(73) Assignee: EXPACK INDUSTRIAL CORPORATION, Taichung (TW)

( * ) Notice: Subject to any disclaimer, the term of this patent is extended or adjusted under 35 U.S.C. 154(b) by 295 days.

(21) Appl. No.: 16/867,305

(22) Filed: May 5, 2020

(65) Prior Publication Data

US 2020/0354095 A1 Nov. 12, 2020

(30) Foreign Application Priority Data

May 10, 2019 (TW) ..... 108205882

(51) Int. Cl.

| | |
|---|---|
| ***B65B 13/22*** | (2006.01) |
| ***B65B 13/32*** | (2006.01) |
| ***B65B 13/18*** | (2006.01) |
| ***B65B 13/02*** | (2006.01) |

(52) U.S. Cl.

CPC ..... *B65B 13/22* (2013.01); *B65B 13/32* (2013.01)

(58) Field of Classification Search

CPC ..... B65B 13/02; B65B 13/22; B65B 13/32; B65B 13/185; B65B 13/187; B65B 13/322; B65B 65/02

USPC ..... 140/150; 72/450, 449; 100/29, 30, 32

See application file for complete search history.

(56) References Cited

U.S. PATENT DOCUMENTS 1,740,725 A 12/1929 Brown
3,650,089 A * 3/1972 Miller ..... B65B 59/005 53/550
3,771,435 A * 11/1973 Vascotto ..... B65B 13/12 100/33 PB
3,841,055 A * 10/1974 Takami ..... B65B 13/22 53/589

(Continued)

FOREIGN PATENT DOCUMENTS

CN 104494897 A * 4/2015 ..... B65B 13/04
CN 105253349 A * 1/2016

(Continued)

OTHER PUBLICATIONS

English translate (CN106347790A), retrieved date Apr. 7, 2022.*

(Continued)

*Primary Examiner* — Jessica Cahill
*Assistant Examiner* — Mohammed S. Alawadi
(74) *Attorney, Agent, or Firm* — McNees Wallace & Nurick LLC

(57) ABSTRACT

A strapping machine includes a driver, first and second power output units, and a switching unit. The first power output unit includes a first drive shaft being co-rotatable with a main shaft of the driver only when the main shaft rotates in a first rotational direction via a first one-way bearing for driving the switching unit, and for clamping, hot-melting and cutting a strap. The second power output unit includes a second drive shaft being co-rotatable with the main shaft only when the main shaft rotates in a second rotational direction via a second one-way bearing, and a plurality of output gear trains being engagable with the second drive shaft via the switching unit for feeding, retracting and tensioning the strap.

8 Claims, 7 Drawing Sheets

(56) References Cited

U.S. PATENT DOCUMENTS

| | | | | | |
|---|---|---|---|---|---|
| 4,120,239 | A * | 10/1978 | Pasic | B65B 13/22 | 226/10 |
| 4,559,767 | A * | 12/1985 | Takami | B65B 13/22 | 100/32 |
| 4,912,908 | A * | 4/1990 | Sakaki | B65B 13/22 | 100/32 |
| 2002/0092271 | A1* | 7/2002 | Kovacs | B29C 66/92615 | 53/64 |
| 2003/0121424 | A1* | 7/2003 | Doyle | B65B 13/28 | 100/29 |
| 2009/0071350 | A1* | 3/2009 | Fay | B65B 13/345 | 100/32 |
| 2013/0276415 | A1* | 10/2013 | Haberstroh | B65B 13/32 | 53/589 |
| 2016/0304224 | A1* | 10/2016 | Foy | B65B 61/06 | |
| 2019/0256233 | A1* | 8/2019 | Sikora | B65B 13/187 | |
| 2020/0223572 | A1* | 7/2020 | Yang | B65B 13/025 | |

FOREIGN PATENT DOCUMENTS

| | | | | |
|---|---|---|---|---|
| CN | 106347790 | A * | 1/2017 | B65B 65/02 |
| JP | S53140583 | U | 11/1978 | |
| JP | S56123213 | A | 9/1981 | |
| JP | S5837981 | U | 3/1983 | |
| JP | S61259912 | A | 11/1986 | |
| JP | S63152953 | U | 10/1988 | |
| JP | 2000103407 | A * | 4/2000 | |
| JP | 2000103407 | A | 4/2000 | |

OTHER PUBLICATIONS

English translate (CN104494897A), retrieved date Apr. 7, 2022.*
English translate (CN105253349A), retrieved date Apr. 7, 2022.*
English translate (JP2000103407A), retrieved date Apr. 7, 2022.*
Office Action issued to Japanese counterpart application No. 2020-082622 by the JPO dated Jul. 12, 2021.

* cited by examiner

STRAPPING MACHINE

CROSS-REFERENCE TO RELATED APPLICATION

This application claims priority of Taiwanese Patent Application No. 108205882, filed on May 10, 2019.

FIELD

The disclosure relates to a piece of packaging machinery, and more particularly to a strapping machine.

BACKGROUND

A conventional automatic strapping machine disclosed in Taiwanese Invention Patent No. I482722 includes a feeding motor and a camshaft motor, each of which performs a plurality of different actions involved in a strapping operation; the feeding motor is in charge of feeding, retracting, and tensioning a strap, while the camshaft motor is in charge of clamping, hot-melting, and cutting the strap.

During the strapping operation, the above-mentioned actions are interspersed with each other in a predetermined order; thus, a controller of such conventional strapping machine has to switch its control repeatedly between the two drivers (i.e. the feeding motor and the camshaft motor) in order to complete all the actions. As a result, in comparison with a controller that controls only one driver, the controller of the conventional strapping machine has a more complex control workflow, which can lead to higher maintenance costs.

SUMMARY

Therefore, the object of the disclosure is to provide a strapping machine that can alleviate the drawback of the prior art.

According to the disclosure, the strapping machine is adapted for strapping an object with a strap. The strapping machine includes a machine body, a feeding roller group, an output regulating device, a clamping unit, a hot-melt unit and a cut-off unit.

The feeding roller group is mounted to the machine body. The output regulating device includes a driver, a first power output unit, a second power output unit and a switching unit.

The driver is mounted to the machine body, and has a main shaft that is rotatable.

The first power output unit includes a first drive shaft that has at least three cams, and a first one-way bearing that is connected between the main shaft and the first drive shaft such that the first drive shaft is co-rotatable with the main shaft when the main shaft rotates in a first rotational direction, and that the first drive shaft is not co-rotatable with the main shaft when the main shaft rotates in a second rotational direction which is opposite to the first rotational direction.

The second power output unit includes a second drive shaft, a transmission gear train, a second one-way bearing and a plurality of output gear trains.

The transmission gear train is connected to the second drive shaft and the main shaft. The second one-way bearing is connected to the transmission gear train and one of the main shaft and the second drive shaft such that the second drive shaft is co-rotatable with the main shaft when the main shaft rotates in the second rotational direction, and that the second drive shaft is not co-rotatable with the main shaft when the main shaft rotates in the first rotational direction.

The output gear trains are mounted to the second drive shaft for actuating operation of the feeding roller group.

The switching unit includes a linking component and a switching component.

The linking component is connected to the second drive shaft, and engages one of the output gear trains such that rotation of the second drive shaft drives the one of the output gear trains to rotate to actuate operation of the feeding roller group for moving the strap.

The switching component is movably connected between the first drive shaft and the linking component such that rotation of the first drive shaft drives the switching component to move the linking component to engage another one of the output gear trains.

The clamping unit is mounted to the machine body, and is connected to one of the cams of the first drive shaft such that rotation of the first drive shaft actuates operation of the clamping unit for clamping the strap.

The hot-melt unit is mounted to the machine body, and is connected to another one of the cams of the first drive shaft such that rotation of the first drive shaft actuates operation of the hot-melt unit for hot-melting the strap.

The cut-off unit is mounted to the machine body, and is connected to another one of the cams of the first drive shaft such that rotation of the first drive shaft actuates operation of the cut-off unit for cutting the strap.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
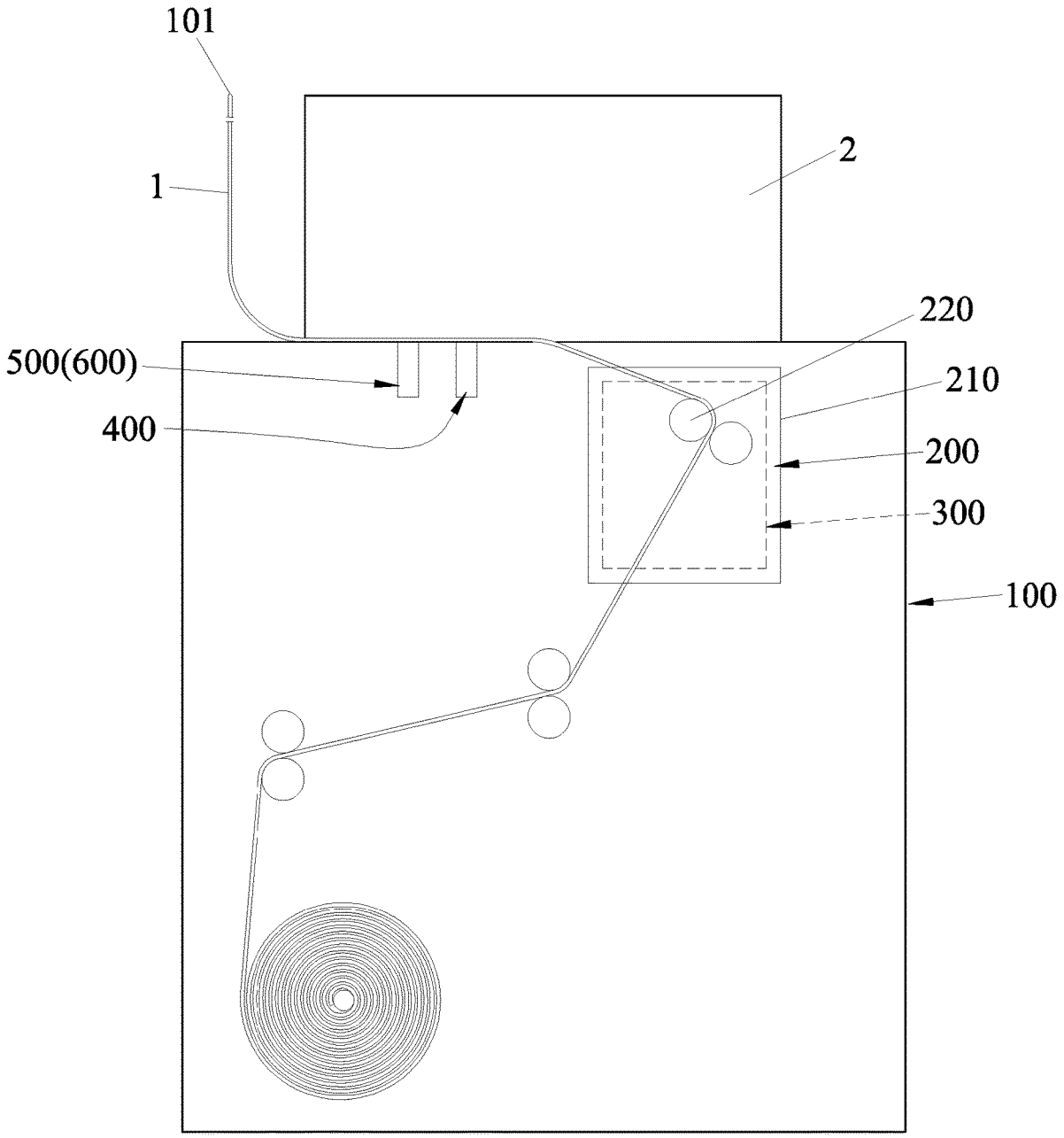
FIG. 1 is a schematic view of an embodiment of a strapping machine according the disclosure.

Referring to FIG. 1, an embodiment of a strapping machine according the disclosure is adapted for strapping an object 2 with a strap 1. The strapping machine includes a machine body 100, a feeding device 200, an output regulating device 300, a clamping unit 400, a hot-melt unit 500 and a cut-off unit 600.

The driving device 200 includes a base seat 210 that is mounted to the machine body 100, and a feeding roller group 220 that is mounted to the base seat 210. The strap 1 is threaded through the feeding roller group 220 such that the feeding roller group 220 is operable for feeding, retracting and tensioning the strap 1.

Figure 2:
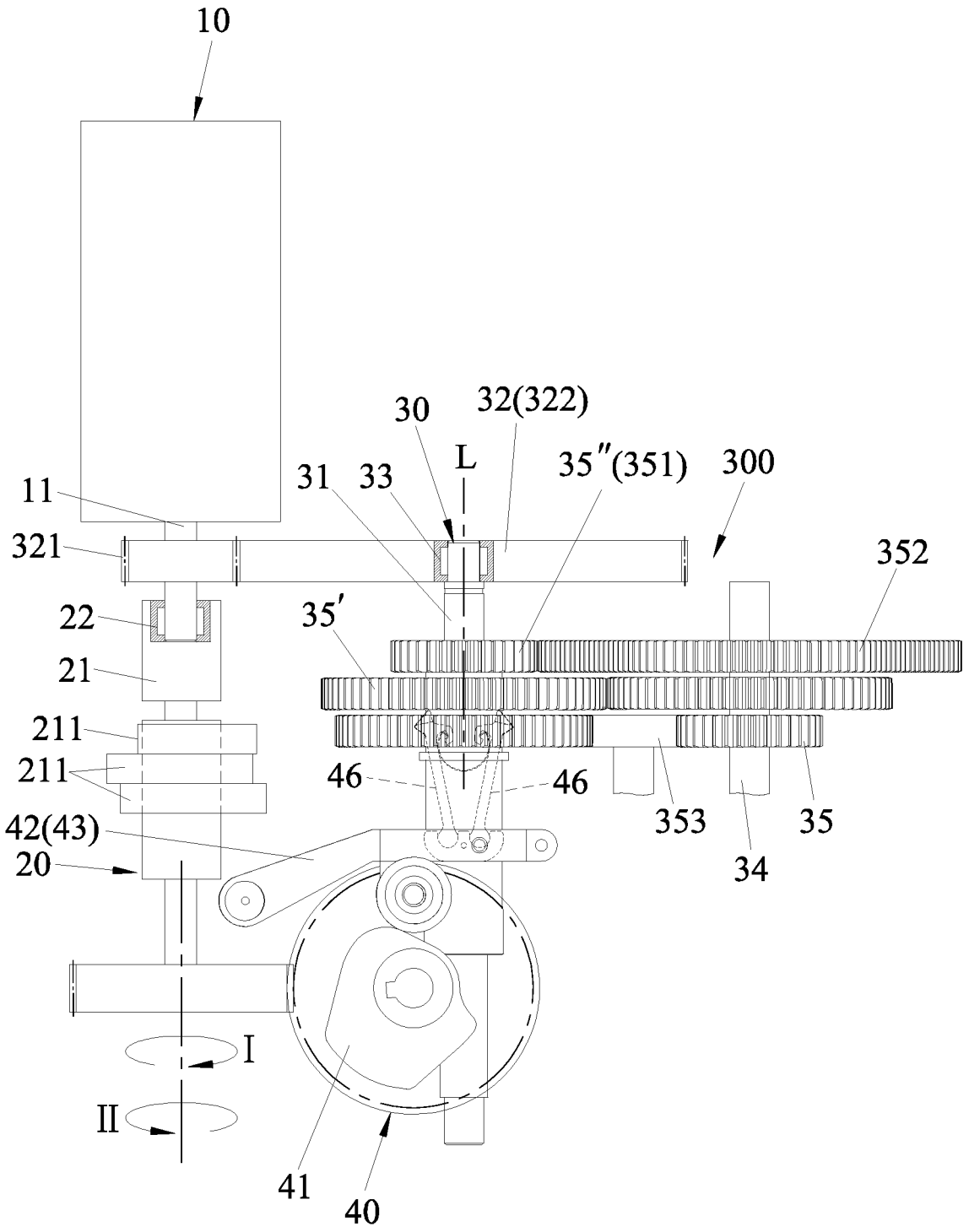
FIG. 2 is a fragmentary side view of an output regulating device of the embodiment, illustrating a driver, a first power output unit and a second power output unit.
Figure 3:
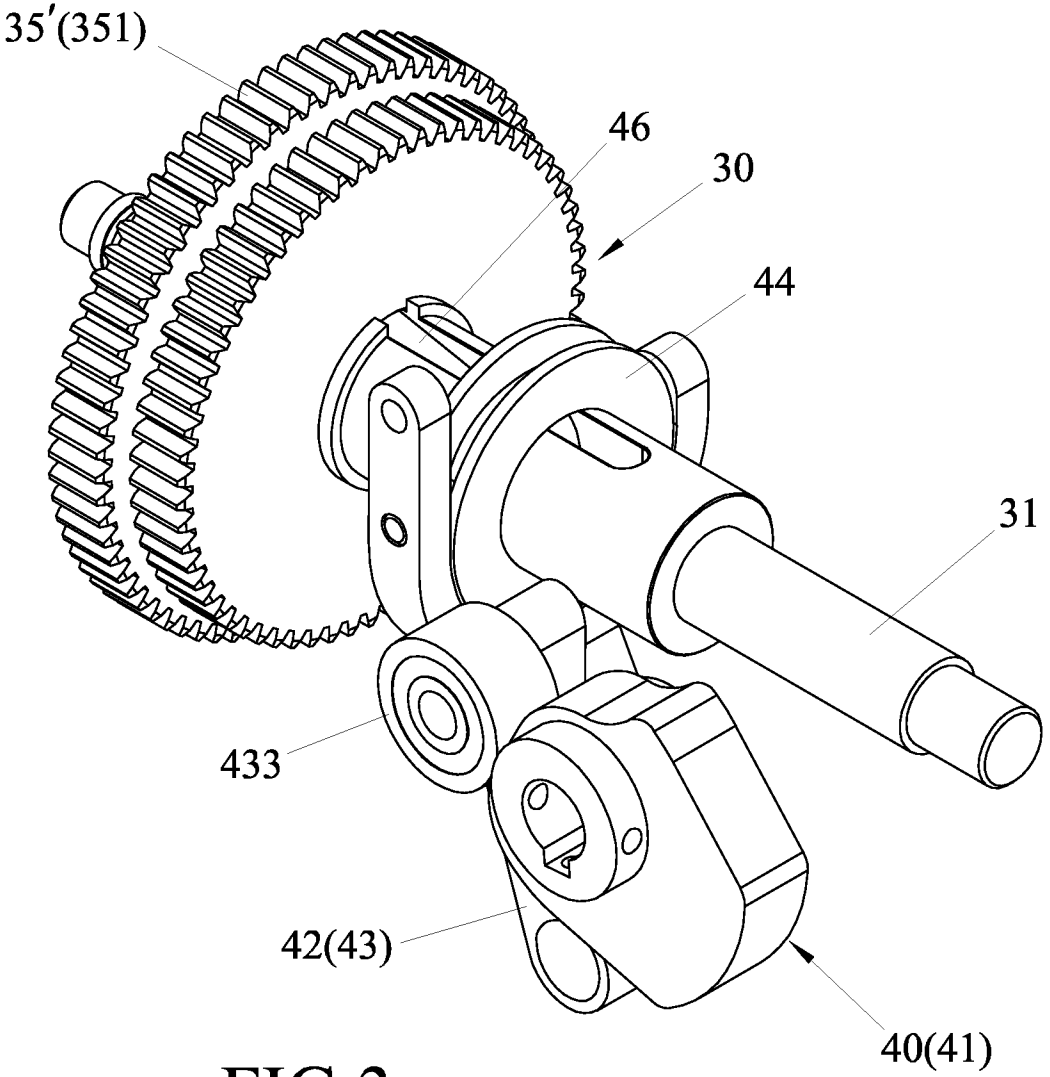
FIG. 3 is a perspective view illustrating part of the second power output unit and a switching unit of the output regulating device.
Figure 4:
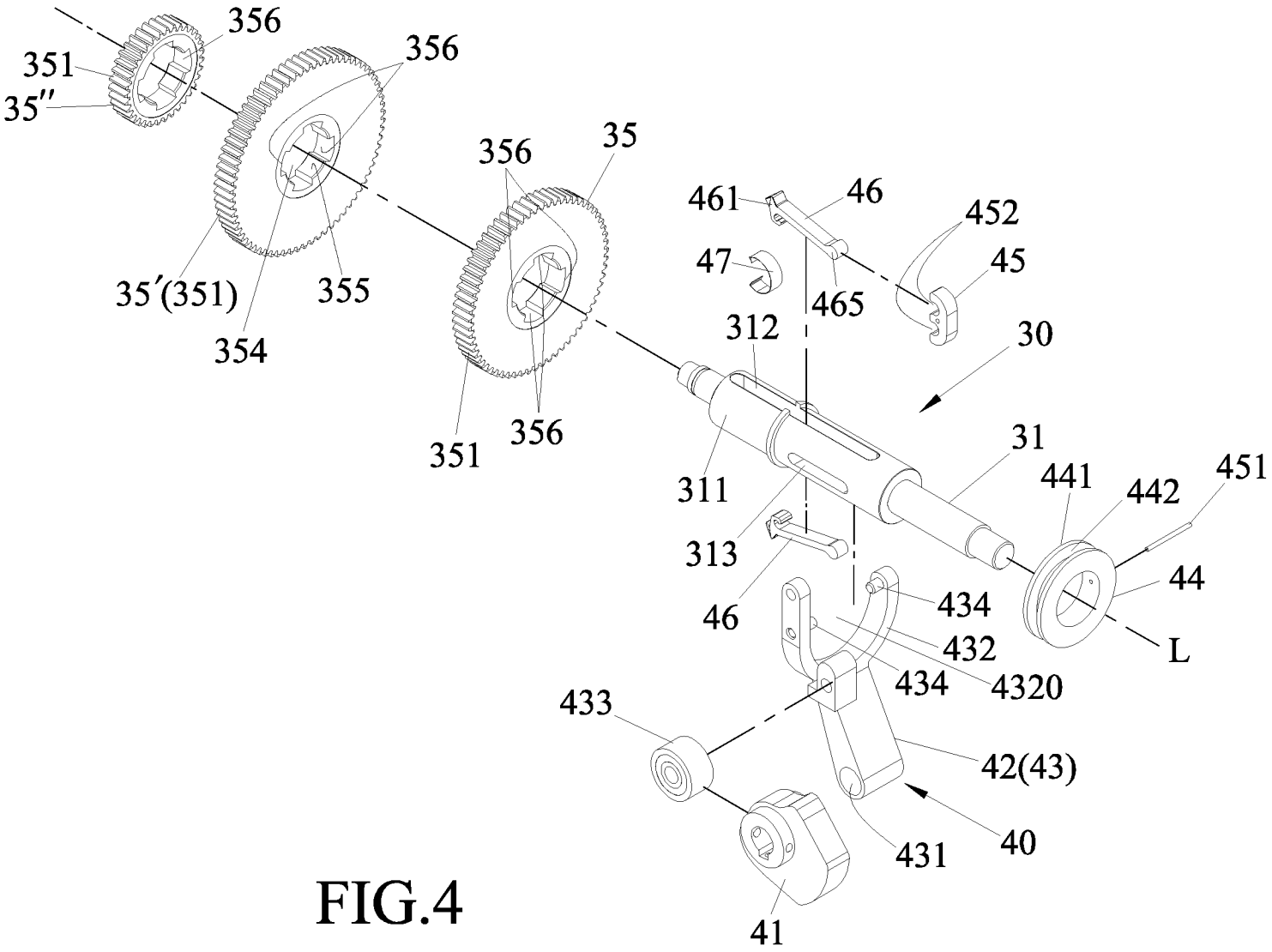
FIG. 4 is an exploded perspective view illustrating the same elements shown in FIG. 3 (i.e. part of the second power output unit and the switching unit)

Referring to FIGS. 2 to 4, the output regulating device 300 includes a driver 10, a first power output unit 20, a second power output unit 30 and a switching unit 40.

The driver 10 is a motor, is mounted to the machine body 100, and has a main shaft 11 that is rotatable.

The first power output unit 20 includes a first drive shaft 21 and a first one-way bearing 22. In this embodiment, the first drive shaft 21 is configured as a camshaft that has three cams 211. The first one-way bearing 22 is connected between the main shaft 11 and the first drive shaft 21 such that the first drive shaft 21 is co-rotatable with the main shaft 11 when the main shaft 11 rotates in a first rotational direction (I) (see FIG. 2), and that the first drive shaft 21 is not co-rotatable with the main shaft 11 when the main shaft 11 rotates in a second rotational direction (II) (see FIG. 2) which is opposite to the first rotational direction (I).

The second power output unit 30 includes a second drive shaft 31, a transmission gear train 32, a second one-way bearing 33, an output shaft 34 and three output gear trains 35, 35', 35".

The second drive shaft 31 extends along an axis (L), has an outer surface 311 that surrounds the axis (L), and is formed with an elongated slot 312 and a pin slot 313. The elongated slot 312 is elongated along the axis (L), and extends in a direction transverse to the axis (L) through opposite ends of the outer surface 311. The pin slot 313 is elongated along the axis (L), and extends in another direction transverse to the axis (L) through the outer surface 311 in a manner that the pin slot 313 intersects the elongated slot 312 inside the second drive shaft 31, that is, the elongated slot 312 and the pin slot 313 are partially overlapped with each other.

The transmission gear train 32 is connected to the second drive shaft 31 and the main shaft 11, and includes a first gear 321 and a second gear 322. The first gear 321 is co-rotatably mounted to the main shaft 11. The second gear 322 is mounted to the second drive shaft 31, and is meshed with the first gear 321.

The second one-way bearing 33 is connected between the second drive shaft 31 and the second gear 322 of the transmission gear train 32 such that the second drive shaft 31 is co-rotatable with the main shaft 11 when the main shaft 11 rotates in the second rotational direction (II), and that the second drive shaft 31 is not co-rotatable with the main shaft 11 when the main shaft 11 rotates in the first rotational direction (I). It should be noted that, the second one-way bearing 33 may be connected to the transmission gear train 32 and either one of the main shaft 11 and the second drive shaft 31. For example, in other embodiments of the disclosure, the second one-way bearing 33 may be connected between the main shaft 11 and the first gear 321 of the transmission gear train 32.

The output shaft 34 extends parallelly to the second drive shaft 31, is rotatable, and is connected to the feeding roller group 220.

The output gear trains 35, 35', 35" are mounted to the second drive shaft 31 and the output shaft 34. Each of the output gear trains 35, 35', 35" includes a driving gear 351 that is sleeved on the second drive shaft 31, and a driven gear 352 that is sleeved co-rotatably on the output shaft 34, and that is meshed with the driving gear 351.

Specifically, in this embodiment, the driving gear 351 of each of the output gear trains 35, 35', 35" is formed with a shaft hole 354, and has an inner surface 355 that defines the shaft hole 354, and that is formed with two pairs of engaging slots 356 spatially communicating with the shaft hole 354. The second drive shaft 31 extends along the axis (L) through the shaft hole 354 of the driving gear 351.

It should be noted that, a speed ratio of the driving gear 351 to the driven gear 352 of each of the output gear trains 35, 35', 35" is different from those of the other output gear trains 35, 35', 35", which results in different output rotational speeds and torques for the output shaft 34. Also, for two of the output gear trains 35, 35', 35", the driving gear 351 and the driven gear 352 are directly meshed with each other. And for the other one of the output gear trains 35, 35', 35", the driving gear 351 and the driven gear 352 are indirectly meshed with each other (see FIG. 2, in which an intermediate gear 353 is meshed between the driving and driven gears 351, 352 of the output gear train 35), such that the driving gear 351 and the driven gear 352 are rotatable in the same direction. In virtue of such configuration, the output gear trains 35, 35', 35" are able to actuate operation of the feeding roller group 220 for different actions (i.e. feeding, retracting and tensioning the strap 1; further details thereof will be mentioned in later paragraphs).

The switching unit 40 includes a switching component 41 and a linking component 42.

The linking component 42 is connected to the second drive shaft 31, and engages the driving gear 351 of one of the output gear trains 35, 35', 35" so as to couple the driving gear 351 of the one of the output gear trains 35, 35', 35" co-rotatably to the second drive shaft 31. In such a manner, rotation of the second drive shaft 31 drives the one of the output gear trains 35, 35', 35" to rotate to actuate operation of the feeding roller group 220 for moving the strap 1.

The switching component 41 is movably connected between the first drive shaft 21 and the linking component 42 such that rotation of the first drive shaft 21 drives the switching component 41 to move the linking component 42 to engage another one of the output gear trains 35, 35', 35"; that is, the linking component 42 is movable by the switching component 41 to disengage from the driving gear 351 of the one of the output gear trains 35, 35', 35", and to couple the driving gear 351 of the another one of the output gear trains 35, 35', 35" co-rotatably to the second drive shaft 31.

Specifically, the linking component 42 includes a swing arm 43, a slide ring 44, a connector 45, two claw members 46, a resilient member 47, and a retaining pin 451.

The swing arm 43 is mounted to the machine body 100, is driven pivotably by the switching component 41, and has a pivot portion 431, a U-shaped frame 432 and a wheel member 433.

The pivot portion 431 of the swing arm 43 is connected to the machine body 100 as a pivot for the swing arm 43. The U-shaped frame 432 of the swing arm 43 is opposite to the pivot portion 431, defines a receiving space 4320, and has opposite ends formed respectively with two pins 434 that protrude inwardly toward each other. The wheel member 433 of the swing arm 43 is disposed between the pivot portion 431 and the U-shaped frame 432. In the present embodiment, the switching component 41 is configured as a cam that is in sliding contact with the wheel member 433 for driving pivotal movement of the swing arm 43.

The slide ring 44 has an outer surrounding surface 441 that surrounds the axis (L), and a looped groove 442 that is formed in the outer surrounding surface 441. The slide ring 44 is slidably sleeved on the second drive shaft 31, and is connected to the swing arm 43 in a manner that the slide ring 44 is received in the receiving space 4320 of the swing arm 43, and that the pins 434 of the swing arm 43 are movably engaged with the looped groove 442 of the slide ring 44. As such, the pivotal movement of the swing arm 43 drives the slide ring 44 to slide along the second drive shaft 31.

The connector 45 is disposed in the elongated slot 312, is formed with two pivot grooves 452, and is connected to the slide ring 44 via the retaining pin 451. Therefore, when the slide ring 44 slides along the second drive shaft 31, the connector 45 moves simultaneously in the elongated slot 312. More specifically, the retaining pin 451 extends through the connector 45, and has opposite ends extending out of the pin slot 313 and connected to the slide ring 44; thus, since the retaining pin 451 is confined to the pin slot 313, a collective movement of the retaining pin 451, the connecter 45 and the slide ring 44 along the axis (L) is retained in a specific range.

The claw members 46 are disposed at opposite ends of the elongated slot 312. Each of the claw members 46 has a pivot tab 465 and an engaging tab 461 that is opposite to the pivot tab 465, and that protrudes out of the elongated slot 312.

The pivot tabs 465 of the claw members 46 engage respectively the pivot grooves 452 of the connector 45 such that the claw members 46 are pivotable relative to the connector 45.

The engaging tabs 461 of the claw members 46 engage respectively one pair of the engaging slots 356 of the driving gear 351 of the one of the output gear trains 35, 35', 35" so as to couple the driving gear 351 of the one of the output gear trains 35, 35', 35" co-rotatably to the second drive shaft 31 as mentioned. When the linking component 42 is moved by the switching component 41, the engaging tabs 461 of the claw members 46 engage respectively one pair of engaging slots 356 of the driving gear 351 of the another one of the output gear trains 35, 35', 35", so as to couple the driving gear 351 of the another one of the output gear trains 35, 35', 35" co-rotatably to the second drive shaft 31.

The resilient member 47 is disposed between the claw members 46 for biasing the engaging tabs 461 of the claw members 46 away from each other, thereby securing engagement between the engaging tabs 461 and the one pair of the engaging slots 356 of the driving gear 351 of the corresponding one of the output gear trains 35, 35', 35". However, in other embodiments of the disclosure, the resilient member 47 may not be included in the switching unit 40. For example, the claw members 46 may be made of a flexible material and be fixedly connected to the connector 45 such that the claw members 46 are able to flexibly engage the engaging slots 356 of the corresponding driving gear 351 without the resilient member 47 exerting a biasing force therebetween.

Referring again to FIGS. 1 and 2, the clamping unit 400 is mounted to the machine body 100, and is connected to one of the cams 211 of the first drive shaft 21 such that rotation of the first drive shaft 21 actuates operation of the clamping unit 400 for clamping the strap 1.

The hot-melt unit 500 is mounted to the machine body 100, and is connected to another one of the cams 211 of the first drive shaft 21 such that rotation of the first drive shaft 21 actuates operation of the hot-melt unit 500 for hot-melting the strap 1.

The cut-off unit 600 is mounted to the machine body 100, and is connected to another one of the cams 211 of the first drive shaft 21 such that rotation of the first drive shaft 21 actuates operation of the cut-off unit 600 for cutting the strap 1.

To provide a thorough understanding of the structure of the strapping machine, a strapping operation including actions such as feeding, retracting and tensioning of the strap 1 is described as follows.

Figure 5:
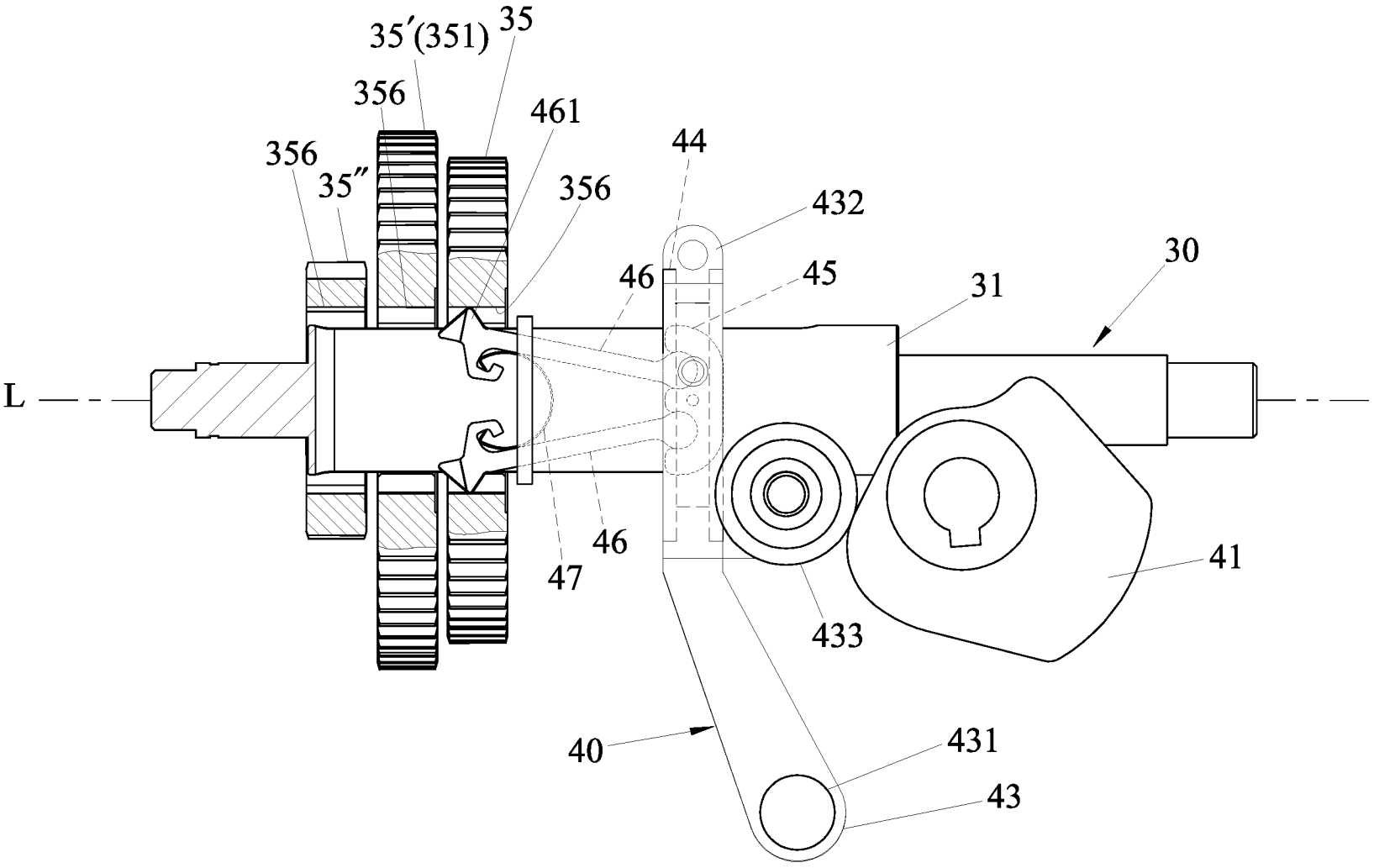
FIG. 5 is a fragmentary, partly sectional view illustrating the switching unit being engaged with one of three output gear trains of the second power output unit.

Referring to FIGS. 1, 2 and 5, in the beginning of the strapping operation, the object 2 is disposed on the machine body 100 of the strapping machine. The claw members 46 of the linking component 42 of the switching unit 40 are engaged with the output gear train 35.

When the driver 10 starts to rotate the main shaft 11 in the second rotational direction (II), the transmission gear train 32 drives the second drive shaft 31 and the driving gear 351 of the output gear train 35 to co-rotate in the first rotational direction (I), and in turn drives the corresponding driven gear 352 and the output shaft 34 to co-rotate in the first rotational direction (I) as well (via the intermediate gear 353). As a result, the feeding roller group 220, driven by the output shaft 34, feeds the strap 1 out of the strapping machine for wrapping the object 2.

When the strap 1 thoroughly surrounds the object 2 such that an end 101 of the strap 1 (see FIG. 1) reaches a specific position and is detected by a sensor (not shown), the driver 10 is triggered to rotate the main shaft 11 in the first rotational direction (I) instead, and to drive the first drive shaft 21 and the cams 211 thereof to rotate, thereby actuating the clamping unit 400 to clamp the strap 1.

Figure 6:
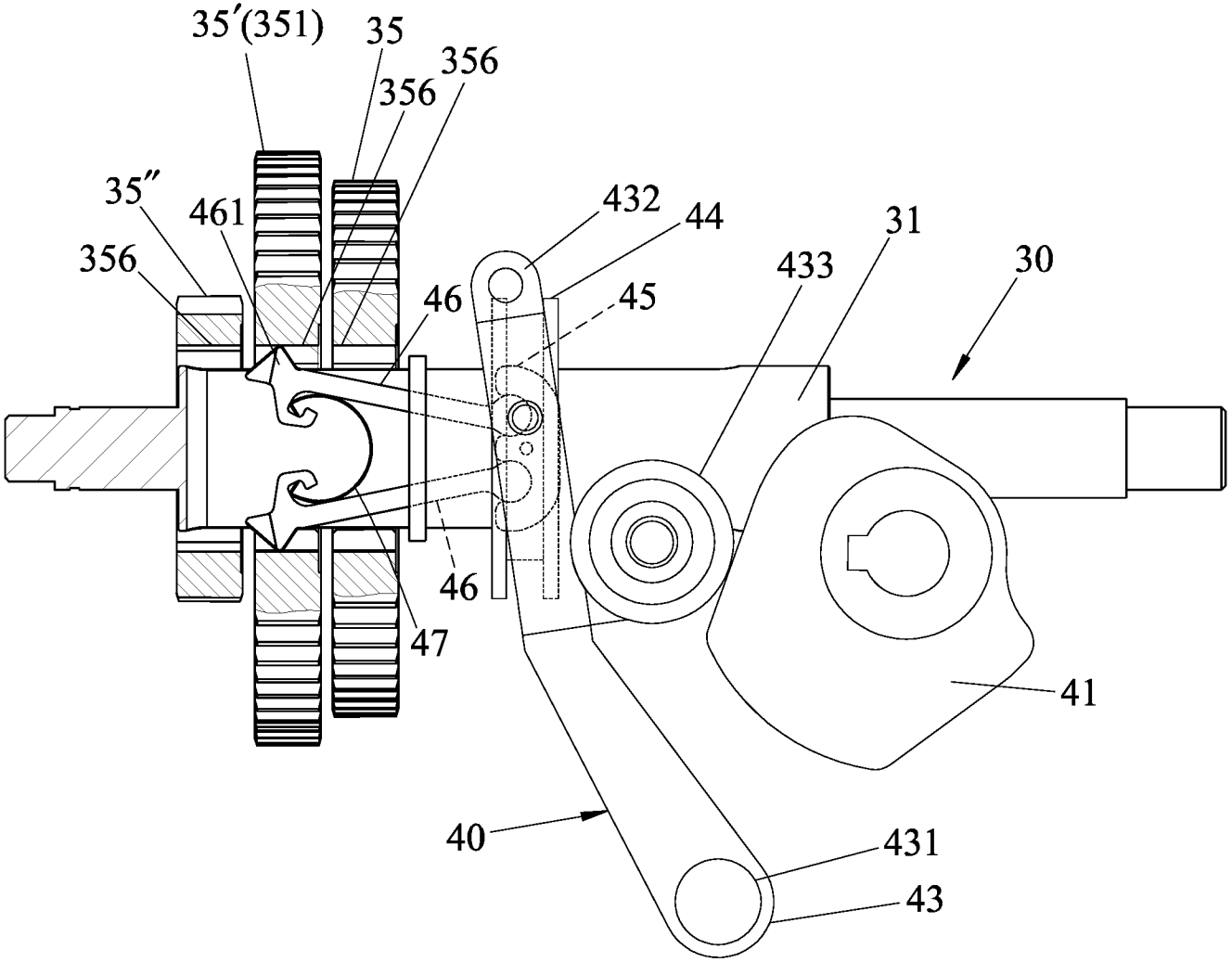
FIG. 6 is a view similar to FIG. 5, illustrating the switching unit being engaged with another one of the output gear trains of the second power output unit.

Next, referring to FIG. 6 together with FIGS. 1 and 2, the main shaft 11, still rotating in the first rotational direction (I), drives rotation of the switching component 41 of the switching unit 40, thereby pushing the linking component 42 to disengage the claw members 46 from the output gear train 35 and to engage, for example, the output gear train 35'.

Then, the driver 10 is triggered to rotate the main shaft 11 in the second rotational direction (II) again. At this time, the transmission gear train 32 drives the second drive shaft 31 and the driving gear 351 of the output gear train 35' to co-rotate in the first rotational direction (I), which in turn drives the corresponding driven gear 352 and the output shaft 34 to co-rotate in the second rotational direction (II). As a result, the feeding roller group 220 starts retracting the strap 1 so that the strap 1 wraps fittingly around the object 2.

Figure 7:
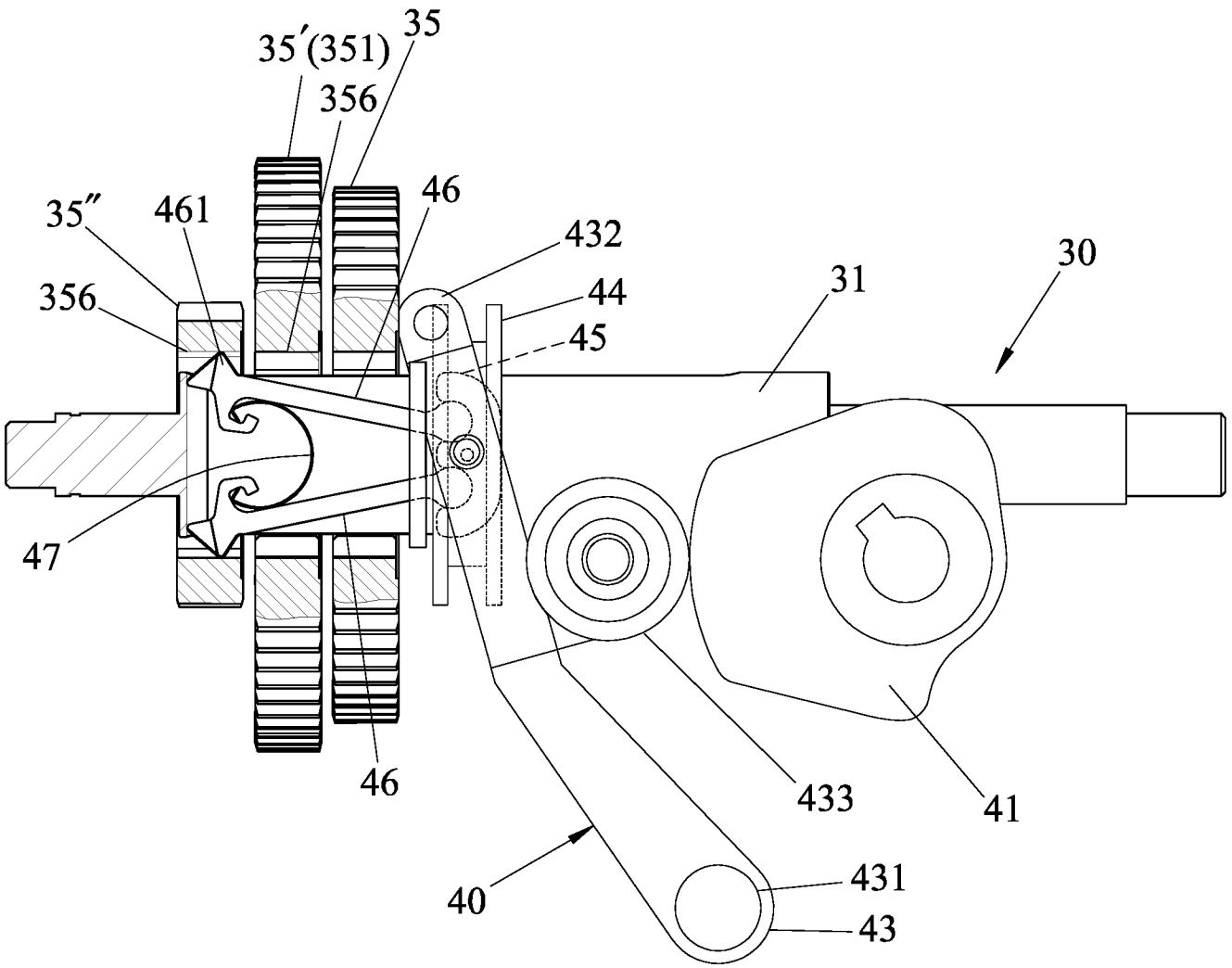
FIG. 7 is yet a view similar to FIG. 5, illustrating the switching unit being engaged with the other one of the output gear trains of the second power output unit.

After that, referring to FIG. 7 together with FIGS. 1 and 2, the driver 10 is triggered to rotate the main shaft 11 in the first rotational direction (I) again, driving the rotation of the switching component 41 of the switching unit 40, thereby pushing the linking component 42 to disengage the claw members 46 from the output gear train 35' and to engage, for example, the output gear train 35".

Next, the driver 10 is triggered to rotate the main shaft 11 in the second rotational direction (II). Simultaneously, the transmission gear train 32 drives the second drive shaft 31 and the driving gear 351 of the output gear train 35" to co-rotate in the first rotational direction (I), which in turn drives the corresponding driven gear 352 and the output shaft 34 to co-rotate in the second rotational direction (II) again, yet with a lower rotational speed and a higher output torque. As a result, the feeding roller group 220 tensions the strap 1 so that the strap 1 wraps tightly around the object 2.

Finally, the driver 10 is triggered to rotate the main shaft 11 in the first rotational direction (I), driving the first drive shaft 21 and the cams 211 thereof to rotate, and thereby actuating the hot-melt unit 500 to hot-melt the strap 1 for securing the strap 1 around the object 2. Then, the cut-off unit 600 is actuated to cut the strap 1 so that the object 2 can be removed from the strapping machine, and the strapping operation is completed.

It should be noted that, a resilient component (not shown) is connected between the linking component 42 and the machine body 100, such that after the strapping operation is completed and that the switching component 41 is no longer pushing the linking component 42, the linking component 42 is biased by the resilient component to engage the output gear train 35 again for the next strapping operation.

In sum, by virtue of the output regulating device 300 that includes two separate power output units (i.e. the first and second power output units 20, 30) and the switching unit 40, the present embodiment of the strapping machine is able to complete all the necessary actions (i.e., the feeding, retracting, tensioning, clamping, hot-melting, and cutting of the strap 1) with one driver. Thus, compared with the prior art, the present embodiment has a simpler control workflow, which requires lower maintenance costs. Moreover, having one driver instead of two, the present embodiment may be designed with a more compact form factor.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A strapping machine adapted for strapping an object with a strap, said strapping machine comprising:

a machine body;

a feeding roller group that is mounted to said machine body;

an output regulating device that includes a driver mounted to said machine body, and having a main shaft that is rotatable, a first power output unit including a first drive shaft that has at least three cams, and a first one-way bearing that is connected between said main shaft and said first drive shaft such that said first drive shaft is co-rotatable with said main shaft when said main shaft rotates in a first rotational direction, and that said first drive shaft is not co-rotatable with said main shaft when said main shaft rotates in a second rotational direction which is opposite to the first rotational direction, a second power output unit including a second drive shaft, a transmission gear train that is connected to said second drive shaft and said main shaft, a second one-way bearing that is connected to said transmission gear train and one of said main shaft and said second drive shaft such that said second drive shaft is co-rotatable with said main shaft when said main shaft rotates in the second rotational direction, and that said second drive shaft is not co-rotatable with said main shaft when said main shaft rotates in the first rotational direction, and a plurality of output gear trains that are mounted to said second drive shaft for actuating operation of said feeding roller group, and a switching unit including a linking component that is connected to said second drive shaft, and that engages one of said output gear trains such that rotation of said second drive shaft drives said one of said output gear trains to rotate to actuate operation of said feeding roller group for moving the strap, and a switching component that is movably connected between said first drive shaft and said linking component such that rotation of said first drive shaft drives said switching component to move said linking component to engage another one of said output gear trains;

a clamping unit that is mounted to said machine body, and that is connected to one of said cams of said first drive shaft such that rotation of said first drive shaft actuates operation of said clamping unit for clamping the strap;

a hot-melt unit that is mounted to said machine body, and that is connected to another one of said cams of said first drive shaft such that rotation of said first drive shaft actuates operation of said hot-melt unit for hot-melting the strap; and a cut-off unit that is mounted to said machine body, and that is connected to another one of said cams of said first drive shaft such that rotation of said first drive shaft actuates operation of said cut-off unit for cutting the strap.

2. The strapping machine as claimed in claim 1, wherein:

said second power output unit further includes an output shaft that is rotatable, that extends parallelly to said second drive shaft, and that is connected to said feeding roller group;

each of said output gear trains includes a driving gear that is sleeved on said second drive shaft, and a driven gear that is sleeved co-rotatably on said output shaft, and that is meshed with said driving gear;

a speed ratio of said driving gear to said driven gear of each of said output gear trains is different from those of the other output gear trains; and said linking component of said switching unit engages said driving gear of one of said output gear trains so as to couple said driving gear of said one of said output gear trains co-rotatably to said second drive shaft, and is movable by said switching component of said switching unit to engage another one of said output gear trains so as to couple said driving gear of said another one of said output gear trains co-rotatably to said second drive shaft.

3. The strapping machine as claimed in claim 2, wherein said driving gear and said driven gear of at least one of said output gear trains are directly meshed with each other.

4. The strapping machine as claimed in claim 2, wherein said driving gear and said driven gear of at least one of said output gear trains are indirectly meshed with each other such that said driving gear and said driven gear are rotatable in the same direction.

5. The strapping machine as claimed in claim 2, wherein:

said driving gear of each of said output gear trains is formed with a shaft hole, and has an inner surface that defines said shaft hole, and that is formed with at least one pair of engaging slots spatially communicating with said shaft hole;

said second drive shaft extends along an axis through said shaft hole of said driving gear, has an outer surface that surrounds the axis, and is formed with an elongated slot that is elongated along the axis, and that extends in a direction transverse to the axis through opposite ends of said outer surface;

said linking component includes a swing arm that is mounted to said machine body, and that is driven pivotably by said switching component, a slide ring that is slidably sleeved on said second drive shaft, and that is connected to said swing arm such that pivotal movement of said swing arm drives said slide ring to slide along said second drive shaft, a connector that is disposed in said elongated slot, and that is connected to said slide ring such that said connector moves in said elongated slot when said slide ring slides along said second drive shaft, and two claw members that are disposed at opposite ends of said elongated slot, and that are connected to said connector, each of said claw members having an engaging tab that protrudes out of said elongated slot; and said engaging tabs of said claw members engage respectively said at least one pair of engaging slots of said driving gear of one of said output gear trains so as to couple said driving gear of said one of said output gear trains co-rotatably to said second drive shaft, and is movable by said switching component to engage respectively said at least one pair of engaging slots of said driving gear of another one of said output gear trains so as to couple said driving gear of said another one of said output gear trains co-rotatably to said second drive shaft.

6. The strapping machine as claimed in claim 5, wherein said linking component of said output regulating device further includes a resilient member that is disposed between said claw members for biasing said engaging tabs of said claw members away from each other, thereby securing engagement between said engaging tabs and said at least one pair of engaging slots of said driving gear of the corresponding one of said output gear trains.

7. The strapping machine as claimed in claim 6, wherein:

said slide ring of said linking component has an outer surrounding surface that surrounds the axis, and a looped groove that is formed in said outer surrounding surface; and said swing arm of said linking component has a pivot portion that is connected to said machine body as a pivot for said swing arm, and a U-shaped frame that is opposite to said pivot portion, that defines a receiving space, and that has opposite ends formed respectively with two pins that protrude inwardly toward each other, said slide ring being received in said receiving space, said pins are movably engaged with said looped groove of said slide ring.

8. The strapping machine as claimed in claim 7, wherein:

said swing arm further has a wheel member that is disposed between said pivot portion and said U-shaped frame; and said switching component of said switching unit is configured as a cam that is in sliding contact with said wheel member for driving pivotal movement of said swing arm.

* * * * *